US005140298A

United States Patent [19]

Gordon et al.

[11] Patent Number: 5,140,298

[45] Date of Patent: Aug. 18, 1992

[54] CERAMIC BASE COMPONENT PACKAGING ASSEMBLY

[75] Inventors: James C. Gordon, West Hurley; Eric P. Lovgren, Kingston; Herman P. Meyer, Rifton; Donald P. Rearick, Shokan, all of N.Y.

[73] Assignee: International Business Machines Corporation, Armonk, N.Y.

[21] Appl. No.: 578,698

[22] Filed: Sep. 4, 1990

[51] Int. Cl.[5] ..... H01C 1/02

[52] U.S. Cl. ..... 338/226; 338/252; 338/254; 338/232; 338/277; 338/315; 174/52.1

[58] Field of Search ..... 338/252, 254, 232, 233, 338/226, 277, 315, 316, 317, 328, 22 R; 174/52.1

[56] References Cited

U.S. PATENT DOCUMENTS

| | | | |
|---|---|---|---|
| 4,728,779 | 3/1988 | Kotani et al. | 338/22 R |
| 4,814,584 | 3/1989 | Bohlender et al. | 338/22 R |
| 4,870,249 | 9/1989 | Kayanuma et al. | 338/22 R |
| 4,894,637 | 1/1990 | Yamada et al. | 338/22 R |

*Primary Examiner*—Marvin M. Lateef
*Attorney, Agent, or Firm*—Mark S. Walker

[57] ABSTRACT

A ceramic base component packaging assembly with high thermal transfer rates. The packaging assembly includes a molded plastic cover that receives spring washers, ceramic pads, resistive elements or other electronic components, and a thermally conductive ceramic base. The spring washers press the electronic elements against the ceramic base ensuring good thermal transfer. The ceramic base is an effective thermal conductor and electrical isolator for the device.

9 Claims, 2 Drawing Sheets

CERAMIC BASE COMPONENT PACKAGING ASSEMBLY

BACKGROUND OF THE INVENTION

1. Field of the Invention

The present invention relates to electronic component packaging, and more particularly, to the packaging of electronic components where thermal transfer is important.

2. Description of Related Art

Resistors have long been packaged individually with each resistive element enclosed in protective covering. The heat generated by such a resistor must be dissipated by the surrounding air requiring a steady air flow through the unit. High power applications may generate more heat than an air cooled system can handle.

Conduction cooled resistors are used in high peak power applications. These resistors, such as the Dale resistors manufactured by the Dale Corporation, generate substantial heat and are surrounded by a conduction cooled jacket that removes the heat generated by the resistors. However, Dale resistors for handling the large peak power demands of certain applications would be abnormally large and would require an inordinate amount of space in the unit.

A third packaging solution has been to mount resistors on a porcelain-on-aluminum base for improved thermal transfer to a heat exchanger. The package is conduction cooled by mounting it on a heat exchange surface, e.g., a water cooled surface. The base is made from a relatively thick piece of aluminum (providing thermal transfer) onto which a thin layer of porcelain is deposited to provide electrical insulation. Resistive elements are held in place, for example, by spun ceramic spacers in an attempt to provide tight thermal contact between the resistive elements and the base.

The above structure is subject to certain limitations, however. The porcelain layer is not highly thermally conductive, limiting the heat transfer from the resistive elements to the aluminum base. The spun ceramic spacers, while providing some pressure to maintain the resistive element and base contact, do not ensure that constant pressure is maintained. Finally, the thin porcelain layer is subject to cracking and fracturing which can lead to failure. Cracking of the porcelain layer exposes the conductive aluminum base to electrical contact with the resistive elements and can lead to failure of the component.

A packaging scheme is needed that provides high thermal transfer and ensures that the components maintain tight thermal contact with the package.

SUMMARY OF THE INVENTION

The present invention provides an electronic component packaging assembly with high thermal transfer ability, an ability to dissipate high peak power surges without degradation, ease of assembly, and a low package base failure rate.

The present invention is directed toward a package that has a thick thermally conductive base that is also electrically insulating. A cover is provided with recesses for receiving electronic components and springs for pressing these components into tight thermal contact with the base. The cover slides into place on mating rails in the base thereby maintaining the necessary compressive forces.

DESCRIPTION OF THE PREFERRED EMBODIMENT

The preferred embodiment will be described with reference to the figures in which like components are identically numbered. While the preferred embodiment addresses resistor components, the electronic packaging scheme disclosed herein is equally applicable to any electronic components that require high thermal transfer during operation.

Figure 1:
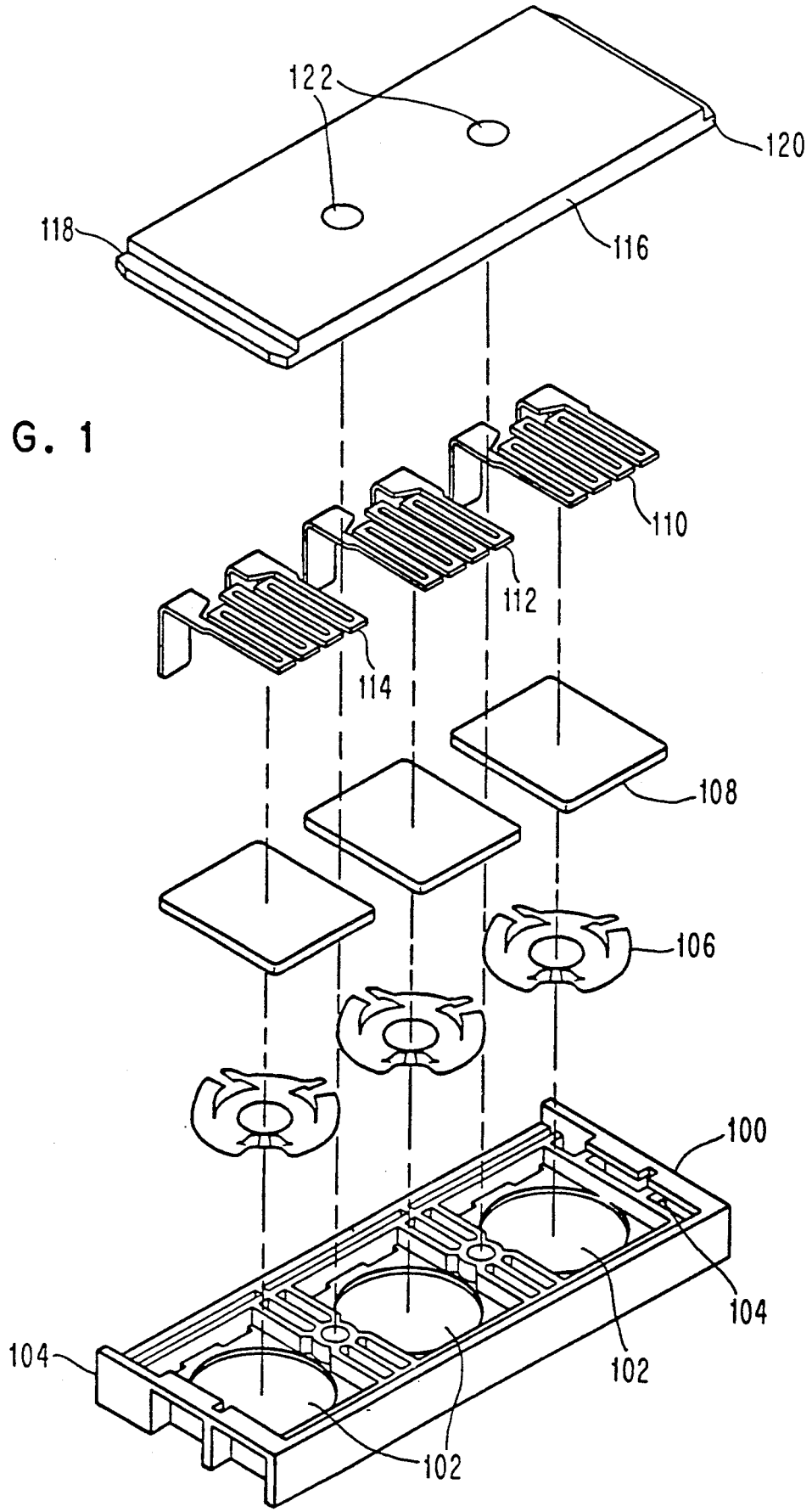
FIG. 1 is an exploded view showing the component parts of the packaging assembly according to the present invention.

FIG. 1 shows an exploded view of a resistor package according to the present invention. The view is shown with the cover on the bottom reflecting the order of assembly of the components. Cover 100 is made from molded plastic and contains recesses 102 for receiving the electrical component subassemblies. Cover 100 is made of molded plastic using known techniques. Slots are provided at each end of cover 100 for receiving a base plate 116. Slot 104 is an example of the slot formation. The use of slots allows components to be assembled and the base held in position pending final fastening of the package to a heat exchanger.

Spring washers, such as that shown at 106, are placed in recess 102 and serve to provide compression pressure to press the electronic component against thermally conductive base 116. The spring washers of the preferred embodiment are bent metal washers similar to the type used in bearings. Spring washers can be any type of commercially available spring washer selected to fit into the recess. The springs hold the electronic elements in tight thermal contact with the base without laterally captivating the elements. The compression is created when the cover is assembled with the base. Slots 104 hold the base tightly against the cover causing the springs to compress the electronic components against base 116. The components are free to expand laterally as temperatures increase thereby reducing the component failure rate.

Insulating pads 108 are provided to evenly distribute the pressure from spring washers 106 across the surface of the electronic component. These insulating pads, in the preferred embodiment, are made from STEATITE, a commercially available ceramic material. In the preferred embodiment, STEATITE is employed providing electrical insulation but low thermal transfer. Thermal transfer to the cover is undesirable because it would lead to increased levels of heat within the device.

Resistive elements such as that shown at 110, are provided for power dissipation. In the preferred embodiment, an iron-chromium-aluminum alloy is employed. A nickel-chromium alloy (NiChrome) can be used in this application with similar results. Chromium alloys are employed for their ability to withstand high peak power in the device. The preferred embodiment includes three resistive elements, 110, 112 and 114, providing conditioning for three phase AC power input. The present invention, however, is not limited to packaging exactly three components, and is generally applicable to a single or any number of components.

Base 116 is made of aluminum oxide (alumina), a ceramic that is an electrical insulator and good thermal conductor. The preferred embodiment uses a base plate which is 96 percent alumina, though any composition in the 94–100 percent range would be equally effective. Other thermally conductive ceramic materials could be employed, such as aluminum nitride or beryllium oxide. The base is formed with rails 118 and 120 that slide into slots 104 on base 100. Two holes 122 are formed in the base plate to receive fasteners (not shown) that fasten the base plate to the cover and are used to mount the package on a heat transfer unit.

Figure 2:
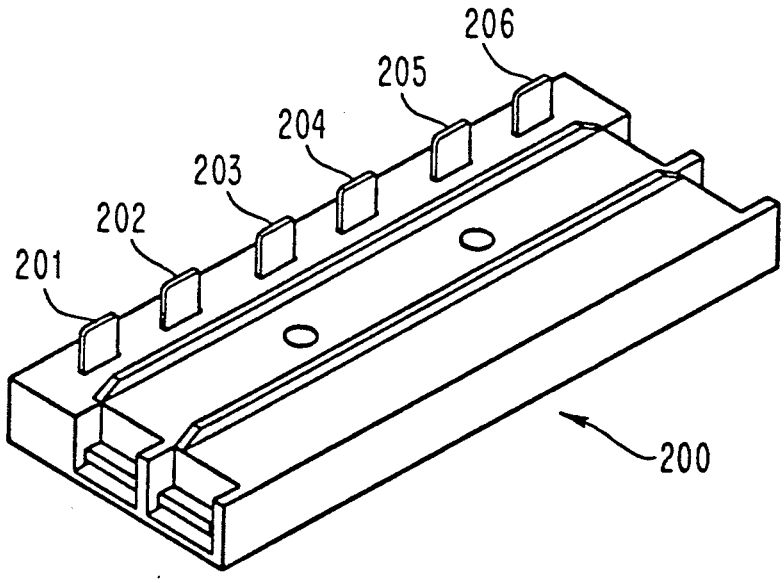
FIG. 2 is a perspective view of the assembled packaging component.

FIG. 2 is a top view showing the entire assembly 200. The terminals of the resistors 110, 112, and 114 protrude through the package and provide positive and negative contact pairs 201 202, 203 204, and 205 206.

In operation, the component package assembly 200 is mounted on a water cooled surface providing conduction heat transfer through the base and away from the assembly. The assembly of the preferred embodiment is capable of dissipating 150 watts (50 watts per element) while maintaining an element tab temperature of less than 100 degrees C. while mounted on a 40 degree C. water cooled plate. The design, however, will support significantly higher heat dissipation requirements. The mounting of the base on a water cooled surface of the preferred embodiment is not meant to limit the application of this device. The heat transfer capability of the system could be employed with other types of liquid cooled or air cooled apparatus. The use of a thick electrically insulating ceramic base also increases the safety factor of the devices by maintaining sufficient clearance between the primary power source and ground. Everything except the electronic component and springs is non-conductive.

It will be understood from the foregoing description that various modifications and changes may be made in the preferred embodiment of the present invention without departing from its true spirit. It is intended that this description is for the purpose of illustration only and should not be construed in a limiting sense. The scope of this invention should be limited only by the language of the following claims.

We claim:

1. An electronic packaging assembly having substantially uni-directional heat transfer, said assembly comprising:

a thermally conducive and electrically insulative base;

a heat generating electronic component, said electronic component having at least one generally planar surface and a plurality of electrical contacts extending in a direction perpendicular and opposite to said generally planar surface, said electronic component mounted such that said planar surface is in tight thermal contact with said base;

a cover, said cover being an electrical insulator and having substantially less thermal conductivity than said base, said cover having at least one recess for receiving said electronic component and apertures through which said electrical contacts extend; and compression means for pressing said electronic component to maintain thermal contact with said base, said compression means disposed in said recess between said cover and said electronic component.

2. The assembly of claim 1 wherein said base is a ceramic material.

3. The assembly of claim 1 wherein said electronic component is a resistor.

4. The assembly of claim 1 wherein said base is made from aluminum oxide.

5. The assembly of claim 1 wherein said compression means comprises:

spring means for maintaining compression and electrical insulating means for electrically isolating said spring means from said electronic component.

6. An inrush resistor assembly for dissipating high inrush currents in an electronic device, said assembly comprising:

a base, said base being an electrical insulator and thermal conductor;

resistance means, said resistance means capable of dissipating high current without failure, and said resistance means being mounted in tight thermal contact with said base,; and compression means for pressing said resistance means into tight thermal contact with said base.

7. The assembly of claim 6 wherein said base is a ceramic material.

8. The assembly of claim 6 wherein said base is made from aluminum oxide.

9. The assembly of claim 6 wherein said compression means comprises:

spring means for maintaining compression and electrical insulating means for electrically isolating said spring means from said resistance means.

* * * * *